US005467068A

United States Patent [19]

Field et al.

[11] Patent Number: 5,467,068

[45] Date of Patent: Nov. 14, 1995

[54] MICROMACHINED BI-MATERIAL SIGNAL SWITCH

[75] Inventors: Leslie A. Field, Portola Valley; Richard C. Ruby, Menlo Park, both of Calif.

[73] Assignee: Hewlett-Packard Company, Palo Alto, Calif.

[21] Appl. No.: 271,811

[22] Filed: Jul. 7, 1994

[51] Int. Cl.[6] ..... H01H 53/00

[52] U.S. Cl. ..... 335/4; 333/104; 333/232; 200/512

[58] Field of Search ..... 200/512, 303; 335/4, 5, 104–105; 333/103–105, 232

[56] References Cited

U.S. PATENT DOCUMENTS 5,047,740 9/1991 Alman .
5,058,856 10/1991 Gordon et al. .
5,121,089 6/1992 Larson .
5,164,688 11/1992 Larson ..... 333/33
5,168,249 12/1992 Larson ..... 333/81 A
5,175,521 12/1992 Larson ..... 333/235
5,374,792 12/1994 Ghezzo et al. ..... 200/16 B

*Primary Examiner*—Lincoln Donovan

[57] ABSTRACT

A micromachined signal switch for vertical displacement includes a fixed substrate having at least one signal line and includes an actuator substrate that is thermally actuated to selectively connect a second signal line to the first signal line. The actuator substrate includes a plurality of legs constructed of materials having sufficiently different coefficients of thermal expansion to create stresses that arc the legs when the legs are subjected to elevated temperatures. In the preferred embodiment, a first material for forming the legs is silicon and a second material is a metal, such as electroplated nickel. A displaceable contact region may be formed integrally with the actuator substrate, but the contact region is preferably a region of an interposer substrate between the fixed substrate and the actuator substrate. The displaceable contact region has a raised position in which the signal line on the fixed substrate is "off" and has a lowered position in which a conductive member on the contact region is positioned to provide electrical communication to the signal line.

20 Claims, 7 Drawing Sheets

MICROMACHINED BI-MATERIAL SIGNAL SWITCH

TECHNICAL FIELD

The present invention relates generally to mechanical switches and more particularly to devices for switching electrical signals.

BACKGROUND ART

Microminiature mechanical switches offer an alternative to semiconductor electronic components as a means for signal switching. U.S. Pat. No. 5,047,740 to Alman describes a miniature switch for controlling microwave signal transmission. A spring-loaded mechanism is controlled by a magnetic solenoid to connect a first microwave signal line to either a second or a third microwave signal line. Solenoid activation pivots an armature which determines the positioning of jumpers relative to the microwave signal lines.

An electrostatically actuated micromachined rotary switch is described in U.S. Pat. No. 5,121,089 to Larson. The rotary switch is fabricated on an integrated circuit wafer using integrated circuit fabrication processing. Microwave transmission lines are positioned to contact a rotating blade of the switch when the rotating blade is properly aligned. Rotation of the blade is controlled by electrostatic fields created by control pads and other switch elements formed on a substrate that also contains the microwave transmission lines.

In a paper entitled "Thermo-Magnetic Flexure Actuators," 0-7803-0456-X/92, 1992 IEEE, Guckel et al. of the University of Wisconsin describe an actuator that utilizes one or both of thermal effects and magnetic forces to cause deflection of beams when an electrical current is applied. While this structure functions well in certain applications, there are difficulties. For example, if the Guckel et al. actuator were to be used as a switch to conduct a signal from the beams to structure that contacts the beams following deflection, signal transmission would be susceptible to feedthrough from the actuator-deflection current. Another difficulty involves inconsistent and even conflicting design requirements for different components of a transmission scheme. A signal line design requires the selection of materials and dimensions to yield a suitable impedance and to minimize signal loss. On the other hand, the actuator of Guckel et al. is designed to achieve a desired deflection in a reliable and efficient manner.

The previously identified patent to Alman lists a number of concerns in the design of a micromachined switch. The switch must be non-particulating and must be adjustable to compensate for changes in the forces which initiate the switching action, e.g., magnetic forces. Moreover, the switch must be reliable over many switching cycles.

What is needed is a microminiature signal switch which minimizes the compromises between fabricating a switch and fabricating signal lines, and which reduces space and cost requirements over conventional combinations of micromachined switches and signal lines.

SUMMARY OF THE INVENTION

The invention provides a thermally actuated signal switch having an actuator supported for reciprocating movement between a raised position in which an electrical circuit is electrically opened and a lowered position in which the circuit is electrically closed. The reciprocating movement is achieved by forming at least a portion of the actuator of materials that have sufficiently different coefficients of thermal expansion to induce displacement in response to the input or release of thermal energy.

Signal lines are formed on a first substrate. The actuator is defined by a substrate that is parallel to the first, or signal, substrate. Typically, the actuator substrate is micromachined to form "bi-metallic" legs that are controlled to selectively move a suspended contact region between the raised and lowered positions that achieve electrical switching. In the preferred embodiment, the actuator substrate is a semiconductor, so that one of the "metals" is semiconductor material. The other material should be one having a sufficiently different coefficient of thermal expansion that the legs are caused to arc as a result of stresses induced by the expansion differential.

The suspended contact region may be formed as an element of the micromachined actuator substrate, but there are thermal, electrical, and mechanical advantages to forming the contact region as a part of a third substrate that is positioned between the signal and actuator substrates. The contact region is aligned with respect to the bi-metallic legs such that arcing of the legs causes motion of the contact region relative to the signal lines of the signal substrate.

The suspended contact region may include a conductive line formed on a side adjacent to the signal substrate. The conductive line is aligned to electrically connect with at least one signal line on the signal substrate when the actuator substrate is in a condition in which the contact region is in the lowered position. For the less desirable embodiment in which the contact region is integral with the bi-metallic legs, the conductive line on the contact region should be on the side of the actuator substrate opposite to the metal layer that is heated to induce displacement. In either embodiment, the conductive line should be electrically isolated from the actuating signal that is used to control displacement of the legs.

The switch may be utilized to control signal transmission at microwave frequencies. Thus, the three substrates may be formed to provide an environment for microwave signal transmission. By "microwave environment" what is meant is that the structure is designed so as to minimize introduction of signal reflections, losses and noise within the microwave frequency range, while maintaining desired isolation between unconnected signal lines and while obtaining reproducible contact between signal lines when connected. Ground planes are formed on the first, signal substrate and on the center substrate. Optionally, a stop is formed on either the contact region or the first substrate to prevent direct contact of the movable conductive line with a signal line on the first substrate. The stop should be positioned to limit movement of the actuator to a position in which the signal lines are sufficiently close to allow passage of high frequencies, i.e., allow electrical connection, but sufficiently spaced apart to filter low frequencies.

The suspended contact region may be a boss extending from the actuator substrate or, if used, from the center substrate. Moreover, the actuator substrate may be micromachined to form more than one actuator on the same substrate. That is, separately operated actuators may be operatively associated with a single electrical circuit.

An advantage of the invention is that because the transmission circuitry is formed on one substrate and the actuator is formed from a second substrate, there is a reduction in the space requirements over conventional combinations of circuitry and mechanical switches. Furthermore, as will be described more fully below, an interposer can be placed between actuator and transmission line circuitry to provide thermal and electrical isolation and to add "scrubbing action." The switches can be fabricated at a low cost and with a high degree of integration. Parasitic capacitance and inductance are significantly reduced, relative to structures in which signals are conducted from one substrate to another in order to undergo a switching process, and then conducted back onto the first substrate. Moreover, fewer compromises need to be made in forming a combination of electrical circuitry and mechanical switches. Particularly in the embodiment in which one or more contact region is formed of a center substrate that is between the signal and actuator substrates, a high degree of thermal isolation is achieved.

BEST MODE FOR CARRYING OUT THE INVENTION

Figure 1:
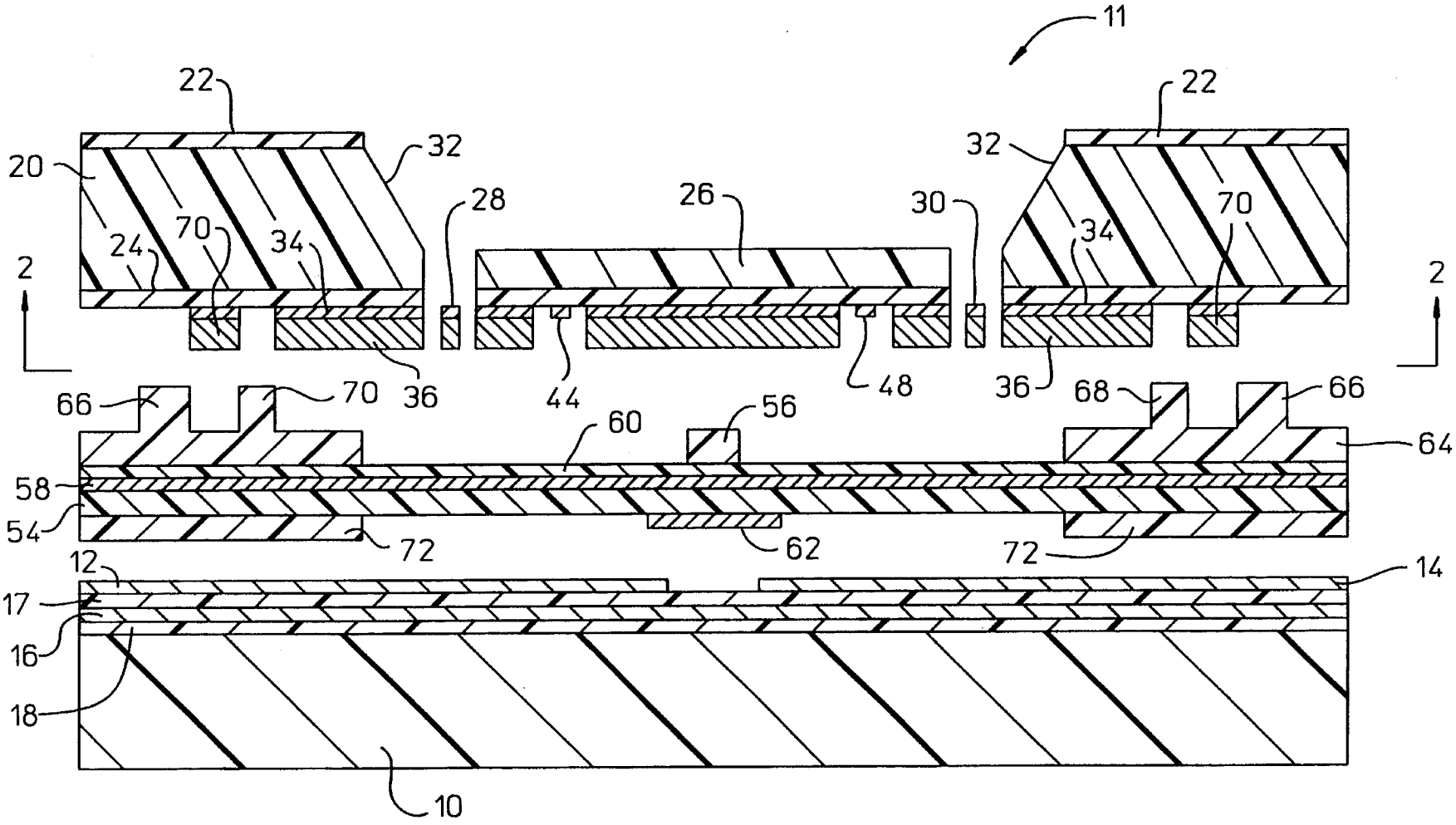
FIG. 1 is a side sectional view of a first embodiment of a thermally actuated switch in accordance with the invention.

With reference to FIG. 1, a switch 11 includes a signal substrate 10 having first and second signal lines 12 and 14. The signal lines may be formed on the substrate using conventional techniques. Photolithographic processing may be utilized to pattern and etch a metallic layer, but the choice of techniques for fabricating signal lines and any electronic devices on the signal substrate 10 may vary according to factors known by persons skilled in the art. In the preferred embodiment, the signal lines are formed of a layer of gold. However, other materials may be utilized.

The selection of a signal substrate 10 is based upon achieving electrical and mechanical characteristics for a particular application. In the preferred embodiment, a microwave environment is formed for transmitting microwave frequencies via the signal lines 12 and 14. Silicon, quartz and semi-insulating gallium arsenide are acceptable materials for the substrate. A flexible copper on a polyimide substrate, commonly known as a "flex circuit," is another substrate candidate, as is sapphire.

A conductive layer 16 is formed on a side of an upper insulating layer 17 opposite to the signal lines 12 and 14. The conductive layer is electrically connected to form a ground plane, thereby establishing a microstrip structure for transmitting microwave signals. The upper insulating layer isolates the signal lines from the ground plane. A lower insulating layer 18 isolates the ground plane 16 from a substrate 10.

Supported at the top of the signal switch 11 is an actuator substrate 20. The length of the actuator substrate is shown as matching that of the signal substrate 10, but a portion of the signal substrate may be left exposed to allow access to input/output pads on the signal substrate. The selection of an actuator substrate is based upon compatibility with micromachining techniques and upon thermal expansion properties. A preferred material is silicon, since silicon possesses the desired mechanical characteristics. However, gallium arsenide may be the preferred material for microwave applications.

Silicon nitride layers 22 and 24 are deposited onto the opposed major surfaces of the actuator substrate 20. The silicon nitride layers are utilized to pattern the actuator substrate. For example, a pair of legs may be formed to provide a central region 26 between suspensions 28 and 30. The first silicon nitride layer 22 is patterned to selectively etch the semiconductor material to form a sloping wall 32 to the central region. The second silicon nitride layer 24 is patterned to etch the actuator substrate 20 from the opposite direction. Other materials may be used instead of silicon nitride, as is readily understood by persons skilled in the art.

The lower surface of the actuator substrate 20 includes a chromium/nickel layer 34 and a thick electroplated nickel layer 36. In one embodiment, chromium is sputtered onto the silicon nitride layer 24, whereafter nickel is sputtered onto the chromium. The chromium/nickel layer 34 then acts as a seed layer for electroplating the thick nickel layer 36.

Figure 2:
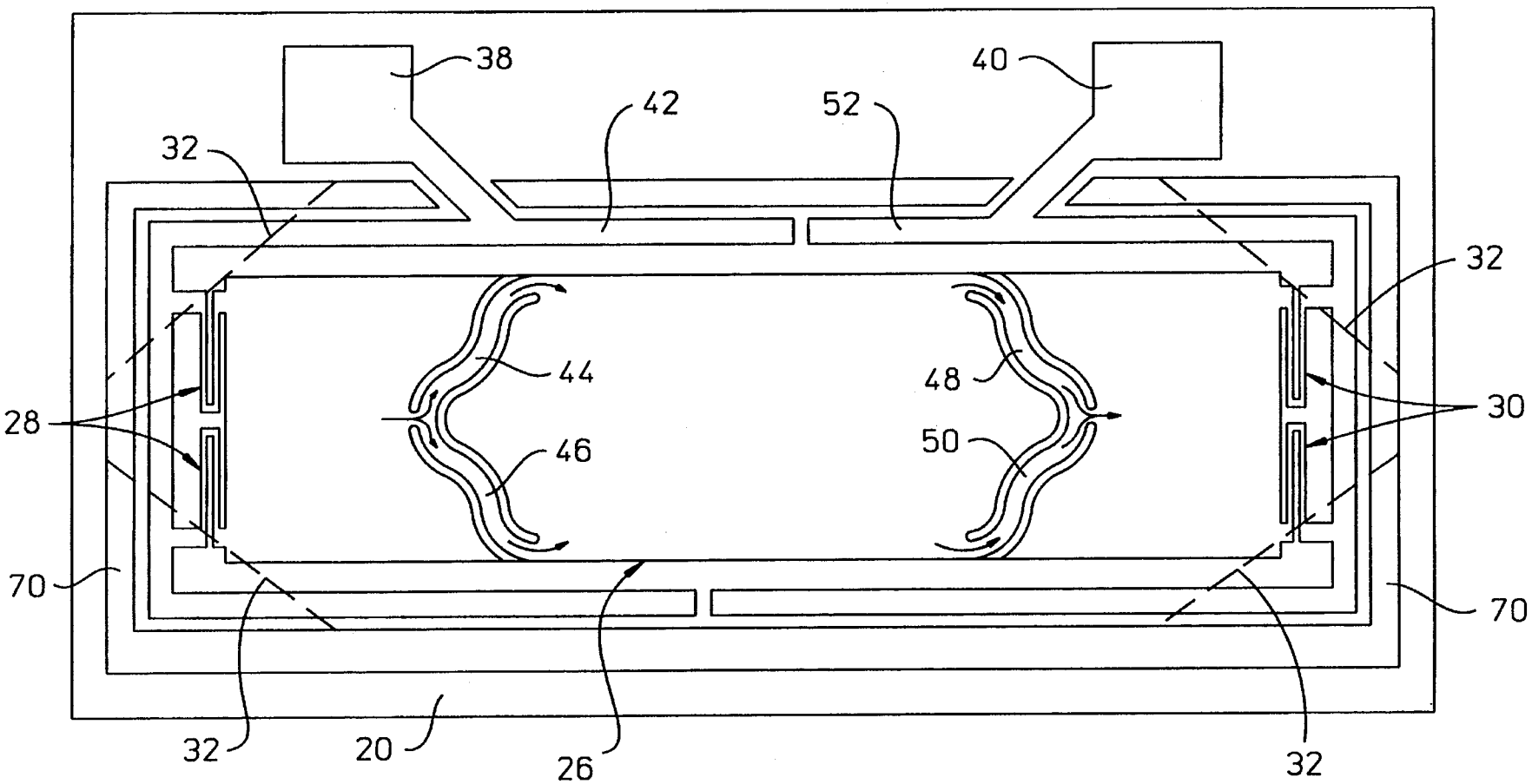
FIG. 2 is a bottom view of an actuator substrate of the thermally actuated switch of FIG. 1, taken along lines 2—2.

The chromium-nickel layer 34 and the plated nickel layer 36 are patterned to form the configuration shown in FIG. 2. The suspensions 28 and 30 are each shown as a pair of spring members that extend from the suspended central region 26 to the thicker outer region of the actuator substrate 20. Dashed lines are included to show the sloped walls 32 formed by etching the substrate to provide the suspended central region 26. Optionally, the two spring members of a suspension may be connected together to increase the stiffness of the suspension.

The plated nickel layer includes a pair of input/output pads 38 and 40. In operation, a source of current is connected to the input/output pads to induce current flow between the pads via the central region 26. The electrical pathway may be considered as originating at pad 38 and extending along a first U-shaped nickel region 42 to the suspension 28. Because the spring members of the suspension 28 are thick plated nickel, the current flow through the central region 26 progresses without a significant voltage drop. However, the central region includes four serpentine heaters 44, 46, 48 and 50 that are formed of the thin, chromium/nickel layer described above. Two of the heaters 44 and 48 are shown in FIG. 1. The metal on the opposed sides of the four heaters is removed to define each heater as a flow path for conducting current from one area of plated nickel to another area of plated nickel. The electrical current through the thinner heaters generates localized heating which then is conducted through the surrounding plated nickel and the semiconductor material of the actuator substrate 20. The difference in coefficients of thermal expansion of the plated nickel layer and the semiconductor material generates stresses that induce deflection of the central region 26. The central region may be considered as comprising two legs and a reciprocating center. A first leg includes heaters 44 and 46 that are electrically parallel and the second leg includes electrically parallel heaters 48 and 50, but the legs are in series. Arrows are shown in FIG. 2 to indicate current flow through the heaters.

The current flow path from the heaters 48 and 50 includes the second suspension 30 and a second U-shaped nickel region 52. The input/output pad 40 is connected to the second U-shaped nickel region 52.

The serpentine heaters 44–50 may be formed to provide 200 mW power at under 2 V, with an electrical current under 200 mA, but the desired voltage, current and heater resistance will vary according to the desired distance of travel for achieving the switching in accordance with the invention. More fundamentally, heat may be generated by other means. While it is convenient to conduct current through the plated and unplated areas of the metallization, it is possible to form separate thin film resistors above or below the "bi-metallic layers" comprising the nickel and the semiconductor material of the central region. Current flow would be then primarily through the thin film resistors.

As previously noted, the central region 26 may be considered as having two legs. Optionally, a greater number of legs may be incorporated. Increasing the number of legs will increase radial symmetry. However, an increase in the number of legs will also require additional area.

Returning to FIG. 1, heat generated as a result of current flow through the heaters 44 and 48 is conducted to the plated nickel 36 and to the semiconductor material of the central region 26. The difference in coefficients of thermal expansion results in deflections that cause the central region to bow downwardly. While the preferred materials include a silicon substrate and include electroplated nickel on a nickel/chromium seed layer, other materials may be used, as long as coefficients of thermal expansion are sufficiently different to ensure that arcing is induced by the "bi-metallic effect" when the actuator substrate is heated.

The Young's moduli of the bi-metallic layers 26 and 36 should be sufficiently high to ensure that the force generated by the bi-metallic effect achieves the desired electrical switching. Another concern in selecting the layer 36 regards the melting point of the material. The layer 36 should have a sufficiently high melting point to ensure that plastic deformation does not occur during deflection of the central region 26 of the actuator substrate 20. Electroplated nickel is the preferred material. Theoretically, copper may be substituted. While aluminum has been used in other bimorphic structures, aluminum has a low yield strength in comparison to nickel and copper and is therefore less suitable over time.

While not critical, the thickness of the nickel layer is approximately equal to the thickness of the actuator substrate at the flexible legs. An acceptable thickness of the nickel layer and the silicon "layer" within the legs is approximately 20 μm. The end-to-end length of the central region 26 may be 10,000 μm. The width of a leg may be 2,800 μm.

Between the signal substrate 10 and the actuator substrate 20 is an interposer substrate 54. The design and the choice of materials for forming the interposer substrate are largely dictated by thermal considerations. When the interposer substrate 54 is connected to the actuator substrate 20, the flow of heat to the interposer substrate should be minimal. Any heat flow to the interposer substrate will increase the power requirements of the switch 11. Moreover, the microwave performance of the signal substrate 10 may be compromised, particularly if electrical circuitry is incorporated onto the signal substrate. Thus, the interposer substrate adds more ground planes to the overall device and provides more flexibility to the designer when setting impedance values and isolation.

The most likely candidates for forming the interposer substrate 54 are polyimide, quartz and silicon. Polyimide may be the preferred material, since it has a low thermal conductivity and is inexpensive. However, there is some difficulty with proper alignment of the polyimide substrate with the signal substrate 10, which is formed of a different material. Alignment will be addressed more thoroughly below. A quartz substrate has a thermal conductivity between that of polyimide and silicon. A concern in the use of a quartz substrate is the ability of a quartz suspension to withstand long-term fatigue. It is likely that use of a quartz interposer would include formation of a central boss, as will be described with reference to FIG. 3. A silicon substrate may also include a central boss, so that thermal losses from the central region of the interposer substrate outwardly and downwardly to the signal substrate 10 can be controlled. Further control of such thermal losses can be achieved by depositing or growing a dielectric, such as a thermal oxide having a thickness of at least 2 μm, on both the top and bottom of the substrate and by limiting the contact area between the interposer substrate and the actuator substrate. Another property that the interposer substrate 54 can provide is scrubbing action. If a central boss is formed and is connected to the body of the interposer substrate via spiral members, the boss will rotate as it is pressed downwardly by the actuator substrate 20 into contact with the signal lines 12 and 14 of the signal substrate 10. The scrubbing action will occur as a signal line 62 on the interposer substrate contacts the signal lines 12 and 14.

In FIG. 1, a raised region 56 is designed to make contact with the portion of the actuator substrate that is to be deflected. The raised region 56 better ensures that the displacement of the actuator substrate is transferred to the interposer substrate 54. Preferably, the raised region should minimize the thermal connection between the two substrates 20 and 54. Thus, the raised region should have a minimal width and should be made of a material having a low thermal conductivity, such as polyimide. Optionally, the raised surface may be replaced with a structure extending downwardly from the central region 26 of the actuator substrate 20.

On the upper surface of the polyimide interposer substrate 54 is a ground plane 58. The ground plane is a conductive film, such as a gold film, to provide shielding for the transmission of microwave signals. Atop the ground plane 58 is a dielectric layer 60, such as an additional layer of polyimide, that electrically insulates the ground plane from the plated nickel layer 36. The signal line 62 defines a contact region of the interposer substrate 54. The signal line 62 is shown as being formed directly onto the polyimide interposer substrate, on a side of the interposer substrate opposite to the ground plane 58. If the interposer substrate were made of silicon, the signal line should be separated from the substrate by a dielectric layer, in order to ensure proper electrical isolation from the ground plane 58.

Coupled to the interposer substrate 54 is an alignment member 64. The alignment member may be formed of polyimide, but this is not critical. The raised region 56 is preferably formed at the same time as the alignment member 64. However, it is possible to form the raised region on the plated nickel layer 36 of the actuator substrate 20, rather than on the interposer substrate.

The alignment member 64 includes projections 66 and 68 that are spaced apart by a distance to receive an alignment ridge 70 formed in the plated nickel layer of the actuator substrate 20. The alignment ridge 70 is also shown in FIG. 2. This structure provides the desired alignment of the interposer substrate to the actuator substrate. While not shown, alignment between the interposer substrate and the signal substrate 10 is achieved similarly by means of downward projections from a spacer 72, with the downward projections being fitted into a patterned structure on the signal substrate. The patterned structure on the signal substrate should be positioned to avoid the signal traces 12 and 14. Alternatively, the three substrates can be aligned by positioning the substrates in an alignment frame.

When assembled, the signal substrate 10, the interposer substrate 54, and the actuator substrate 20 are connected together and deflection of the central region 26 of the actuator substrate causes the signal line 62 of the interposer substrate to come into contact with both of the signal lines 12 and 14 on the signal substrate. Current through the heaters 44–50 causes deflection of the central region 26 by means of the bi-metallic effect, with the deflection being in a downward direction to press the signal line 62 into electrical contact with the signal lines 12 and 14. Termination of the actuating current to the heaters allows the materials of the actuator substrate to contract, returning the structure to the relaxed position shown in FIG. 1.

Figure 3:
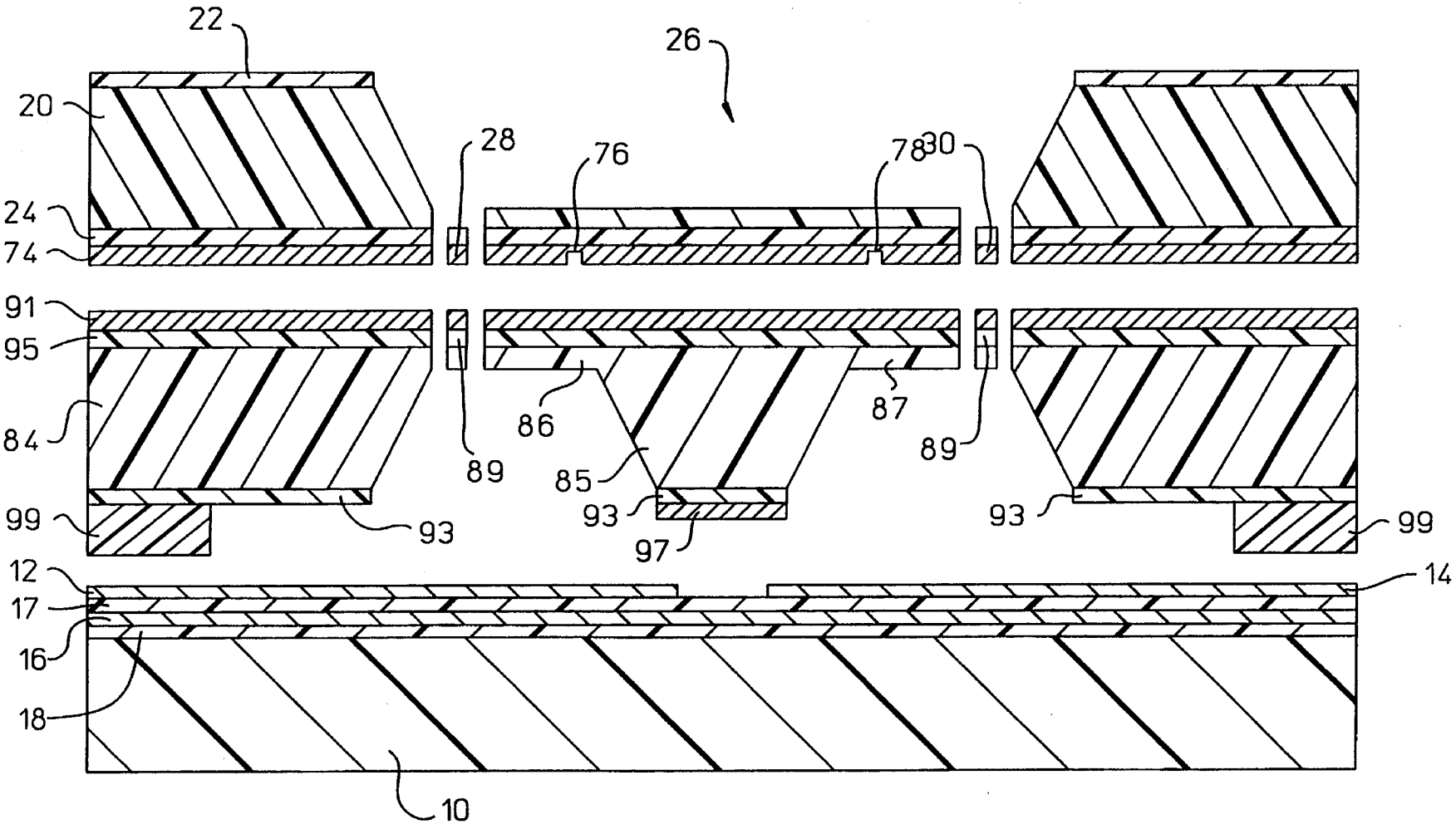
FIG. 3 is a side sectional view of a second embodiment of a thermally actuated switch in accordance with the invention.
Figure 4:
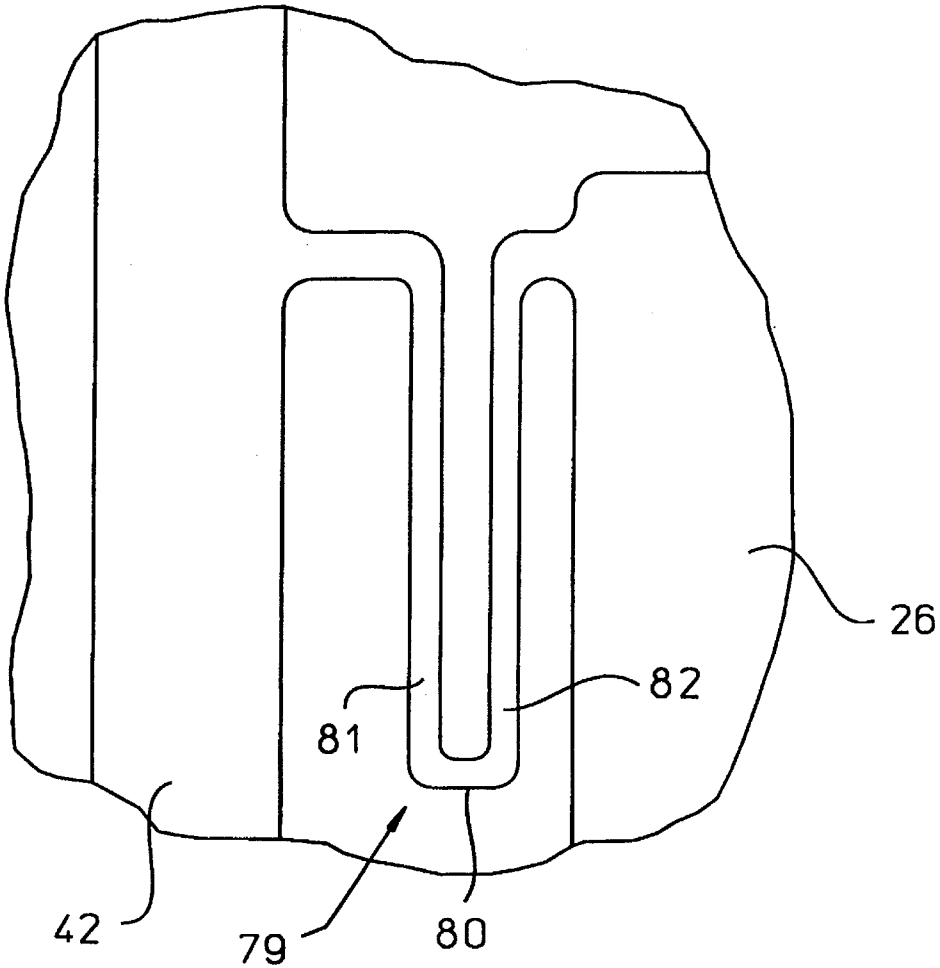
FIG. 4 is a spring member of the actuator substrates of FIGS. 1–3.

A second embodiment of the invention is shown in FIG. 3. A signal substrate 10 is identical to the one described with reference to FIG. 1, so that the reference numerals are repeated. The actuator substrate 20 includes most of the features of the actuator substrate of FIG. 1. However, the chromium/nickel layer and the electroplated nickel layer are shown as a single layer 74. This layer 74 has a uniform thickness, other than at heaters 76 and 78, which comprise merely the chromium/nickel seed layer in order to provide the necessary resistance for generating heat. A portion of a suspension 28 is shown in greater detail in FIG. 4. A spring member 79 includes an elbow 80 that connects first and second arm portions 81 and 82. The suspension serves three roles. Firstly, the suspension provides a degree of thermal isolation of the legs from the stationary portion of the actuator substrate 20. This reduces the amount of thermal energy needed for a desired deflection of the legs. Secondly, the suspension provides rotational flexibility at the end of a leg. The flexibility accommodates the movement experienced as the leg expands and arcs during heating cycles and contracts during relaxation. Thirdly, the suspension provides lateral flexibility in addition to the rotational flexibility, so that the tendency of a leg to pull inwardly as the leg arcs can be accommodated.

The embodiments of FIGS. 1–3 are structures in which the switch is normally open. Optionally, a normally closed switch can be fabricated, in which an actuator substrate moves away from a signal substrate when current is caused to flow through one or more heaters. In a normally closed embodiment, the suspensions are moved away from the outside boundaries of the legs. When the suspensions are at the ends of the legs nearest the center, arcing of the legs will cause movement in the opposite direction of the embodiments of FIGS. 1 and 2.

An interposer substrate 84 of FIG. 3 includes a downwardly depending boss 85 that is aligned with the central region 26 of the actuator substrate 20. Deflection of the central region in a downward direction causes the boss 85 to move in the direction of the signal substrate 10. A pair of legs 86 and 87 connect the boss to the stationary portion of the interposer substrate. Suspensions 89, similar to the suspensions 28 and 30 of FIGS. 1–3, connect the legs 86 and 87 to the stationary portion of the interposer substrate.

On the opposed major surfaces of the interposer substrate 84 are silicon nitride layers 91 and 93. In a microwave environment, the silicon nitride layer 91 on the upper surface insulates the plated layer 74 of the actuator substrate 20 from a ground plane 95 on the interposer substrate. The ground plane is a conductive film that provides shielding for the transmission of microwave signals along signal lines 12 and 14.

The downwardly depending boss 85 forms a contact region for selectively connecting the two signal lines 12 and 14 on the signal substrate 10. A signal line 97 is aligned with respect to the signal substrate to electrically connect the signal lines when the legs 86 and 87 of the interposer substrate 84 are flexed by deflection of the central region 26 of the actuator substrate 20. That is, current through the heaters 76 and 78 on the actuator substrate causes deflection of the central region by means of the bi-metallic effect, with the deflection being in a downward direction to press the signal line 97 into electrical contact with both the signal line 12 and the signal line 14. Termination of the current through the heaters 76 and 78 allows relaxation of the materials, thereby opening the current path.

In the embodiment of FIG. 3, the interposer substrate 84 is more efficiently thermally isolated from the actuator substrate 20 than in the embodiment of FIG. 1. The suspensions 89 and the downwardly depending boss 85 limit contact between the interposer substrate and the signal substrate 10 to contact with a spacer 99, with the suspensions 89 limiting thermal communication between the boss 85 and the spacer 99. When the switch is in the closed position, there is also thermal contact between the conductor area of the interposer substrate and the signal lines 12 and 14 of the signal substrate, which can be reduced by the use of the boss shown in FIG. 3 and by the use of additional dielectric layers, such as thick (> 2 μm) silicon dioxide. The embodiment of FIG. 3 adds some complexity, but may be preferred if the interposer substrate does not have a sufficiently low thermal conductivity to ensure proper thermal isolation of the signal substrate.

As previously noted, the preferred embodiments have actuator central regions that include a plurality of legs. A less desirable embodiment is one in which the central region is a circular structure. In general, the force required to deflect a circular diaphragm includes both a term that increases linearly with displacement and a term that increases as the cube of displacement. For displacements less than approximately the thickness of the diaphragm, the linear term is dominant and the diaphragm is considered to act as a rigid plate. However, for displacements significantly greater than that of the thickness of the diaphragm, the cube term dominates and the element is considered to act as a thin, flexible diaphragm. In the cube-law region, the force required to achieve a given increment of additional deflection builds up rapidly. To double a deflection, the deflection force must be increased as a factor of eight. Because the preferred embodiments include legs, a structure is formed which substantially avoids the cube-law disadvantage. However, with appropriate modifications, the diaphragm approach may be used.

Figure 5:
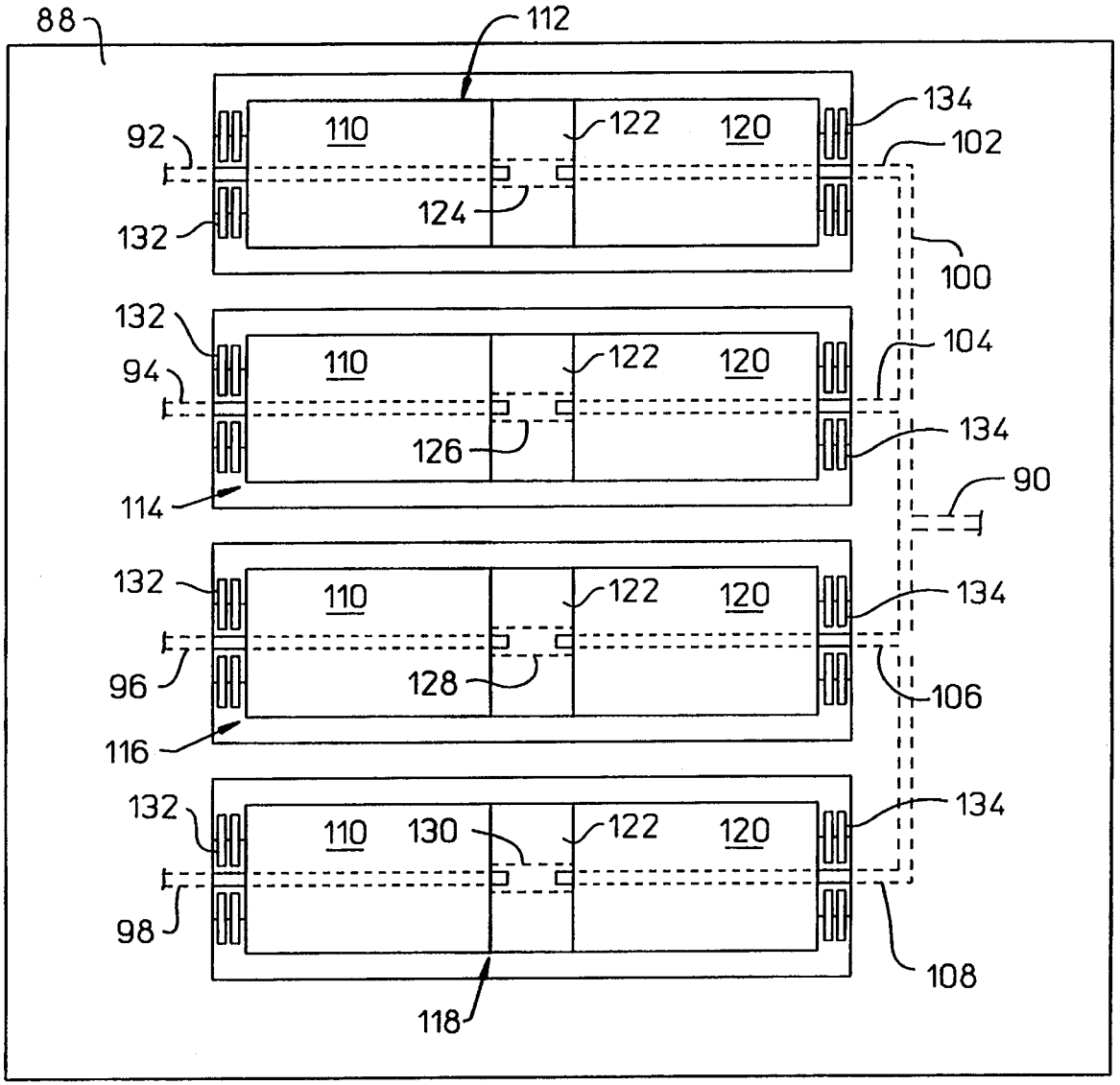
FIG. 5 is a top view of a 1×4 switch in accordance with the invention.

Referring now to FIG. 5, a top view of an actuator 88 of a 1×4 switch is shown schematically. A single input line 90 can independently be connected to any one of four output lines 92, 94, 96 and 98. The input line, the output lines and lines 100, 102, 104, 106 and 108 are all shown in phantom, since in the preferred embodiment the lines are conductive traces on a signal substrate positioned below the actuator substrate 88 and an interposer substrate, not shown.

Each of the output lines 92, 94, 96 and 98 extends beneath the first leg 110 of an individually activated actuator 112, 114, 116 and 118. The traces 102–108 that are connected to the input signal 90 on the signal substrate extend below second legs 120 of the actuators 112–118.

Between the first leg 110 and the second leg 120 of each actuator 112–118 is a bridge 122. Each of the first and second legs includes a heater of the type described above, while the bridge may have a uniform coating of metal. Optionally, the bridge 122 is void of conductive material.

The bridge 122 of each actuator 112-118 is aligned with the contact region of the interposer substrate, not shown. As described above, the contact region has a conductive trace that is brought into electrical contact with signal traces on the signal substrate. Conductive traces 124, 126, 128 and 130 are shown in phantom to represent the conductive traces of the four contact regions aligned below the four actuators 112–118. Thus, when the bridge of one of the actuators is caused to move downwardly by means of the bi-metallic effect created by conducting current through the heaters on the first and second legs 110 and 120, the bridge presses the operatively associated conductive trace 124–130 to connect the input line 90 with one of the output lines 92, 94, 96 or 98.

For simplicity, the heaters are omitted from FIG. 5 and the suspensions 132 and 134 of the first and second legs to the stationary portion of the actuator substrate 88 are shown schematically. In practice, the heaters will be on the lower surface of each of the first and second legs 110 and 120. The heaters will only occupy a portion of each leg. While not critical, the heater may be centered on the lower portion of the leg.

As shown in FIG. 5, the conductive trace 124–130 of each contact region is larger than the two lines 92, 94, 96 and 98 and 102–108 to which the conductive trace must connect. Optionally, the signal lines on the signal substrate may include enlarged areas, or stubs, at the regions which are to connect to the conductive traces 124–130. The stubs increase the likelihood that proper electrical connection is obtained. The signal lines should be designed according to known microwave principles for achieving desired characteristics, e.g., proper isolation of signals and proper avoidance of reflection. For example, terminators may be used to prevent reflections along an open circuit.

While the input traces 102–108 and the output traces 92, 94, 96 and 98 are shown as extending parallel to the length of the four actuators 112–118, this is not critical. Optionally, the traces to be connected may enter at angles to the lengths of the actuators. For example, traces 92 and 102 may be perpendicular to the length of actuator 112 and may not enter the regions below the two legs 110 and 120. In this case, the conductive trace 124 on the contact region below the actuator 112 will extend across the contact region in a direction perpendicular to the direction illustrated in FIG. 5.

Figure 6:
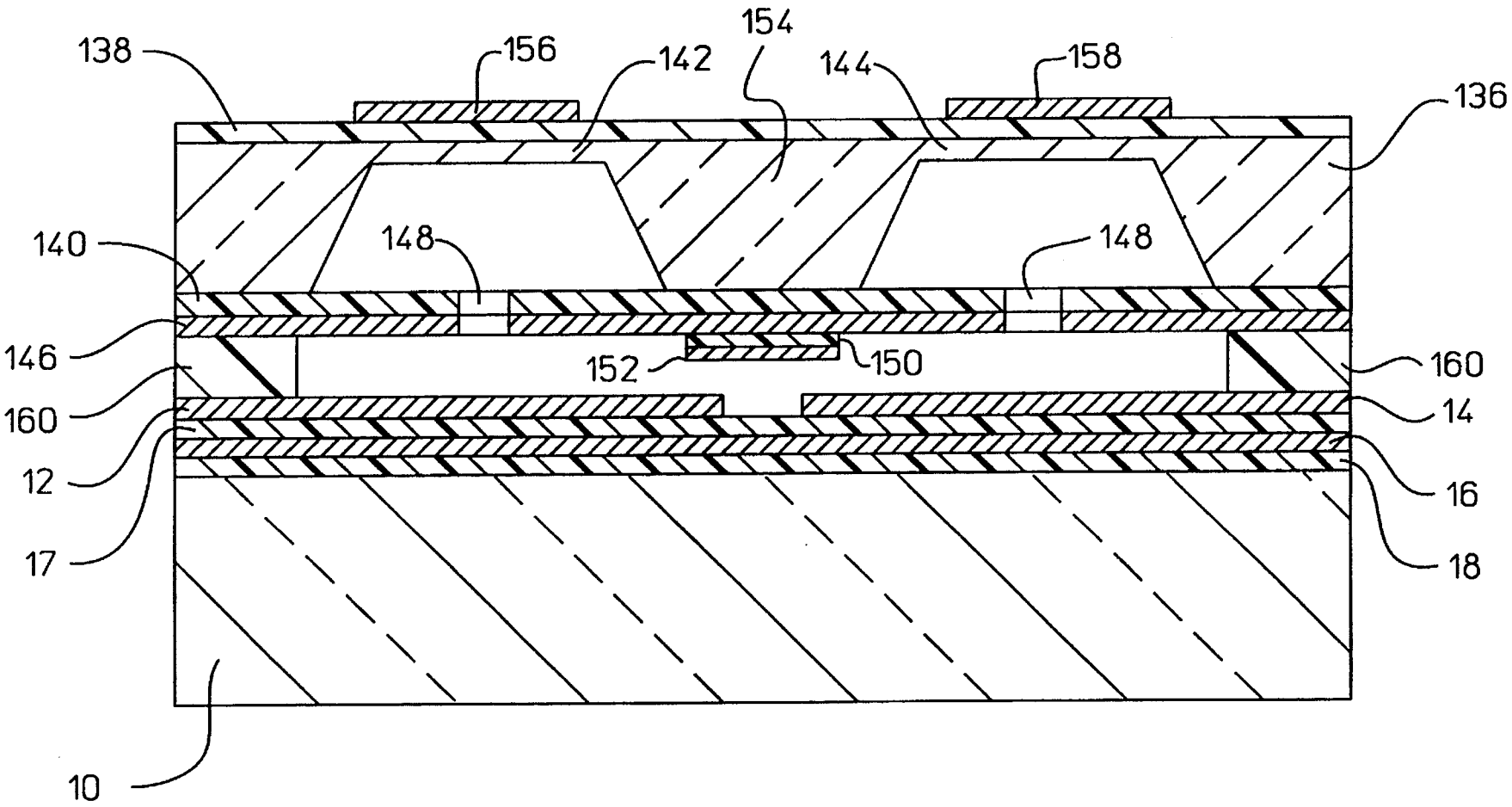
FIG. 6 is a side sectional view of a third embodiment of a thermally actuated switch in accordance with the invention.

A third embodiment of a signal switch is shown in FIG. 6. Because the signal substrate 10 is identical to the signal substrate of FIG. 1, reference to a ground plane layer 16, upper and lower insulating layers 17 and 18, and signal traces 12 and 14 are made using the same numerals as employed in FIG. 1.

An actuator substrate 136 is positioned atop the signal substrate 10. In this embodiment, the actuator substrate remains in an "upright" position, rather than in the inverted position of FIG. 1. Silicon nitride layers 138 and 140 are deposited onto the opposed major surfaces of the actuator substrate. In a microwave environment, the silicon nitride layer 140 on the lower surface remains in the form of a flexible diaphragm when the actuator substrate is etched to define a pair of legs 142 and 144. A conductive film 146, such as a gold film, on the lower surface of the silicon nitride layer 140 is electrically grounded to provide shielding for the transmission of microwave signals. Openings 148 in the layer 140 and the conductive film 146 permit the flow of etchant used to define the legs 142 and 144.

A dielectric layer 150 isolates a signal line 152 from the conductive film 146 that operates as a ground plane. A downwardly depending boss 154 and the signal line 152 are aligned to electrically connect the two signal lines 12 and 14 on the signal substrate 10 when the legs 142 and 144 are flexed by the bi-metallic effect of heating the legs and a plated nickel layer 156 and 158 in the same manner as described with reference to FIG. 1.

The signal line 152 moves upwardly and downwardly in correspondence with movement of the boss 154. In the relaxed condition of FIG. 6, a spacer 160 prevents contact of the signal line 152 with the signal lines 12 and 14 on the signal substrate 10. A suspension structure connects the inward ends of the legs 142 and 144 to the boss. Thus, in contrast to FIGS. 1–3, the suspensions are at the ends of the legs opposite to the stationary portion of the actuator substrate 136. Because the suspension structure is at the end of the legs nearer the boss 154, heating the legs and the nickel layer 156 and 158 causes a downward arcing of the legs, moving the signal line 152 toward the substrate 10.

As previously noted, a power-to-open embodiment may be fabricated, so that a relaxed actuator substrate electrically connects signal lines. For example, a power-to-open switch may be formed by reducing the thickness of the spacer 160 of FIG. 6 and by forming the suspension structures of the legs 142 and 144 at the opposite ends of the legs. The thickness of the spacer 160 could be designed to bring the signal line 152 into electrical connection with the signal lines 12 and 14 when the actuator substrate 136 is in the relaxed condition. With the suspension structure at the ends of the legs nearer the stationary portion of the actuator substrate 136, stresses created by the bi-metallic effect will be accommodated in a manner which moves the boss 154 in an upward direction, thereby opening the circuit when current is conducted through the serpentine heaters 156 and 158.

Figure 7:
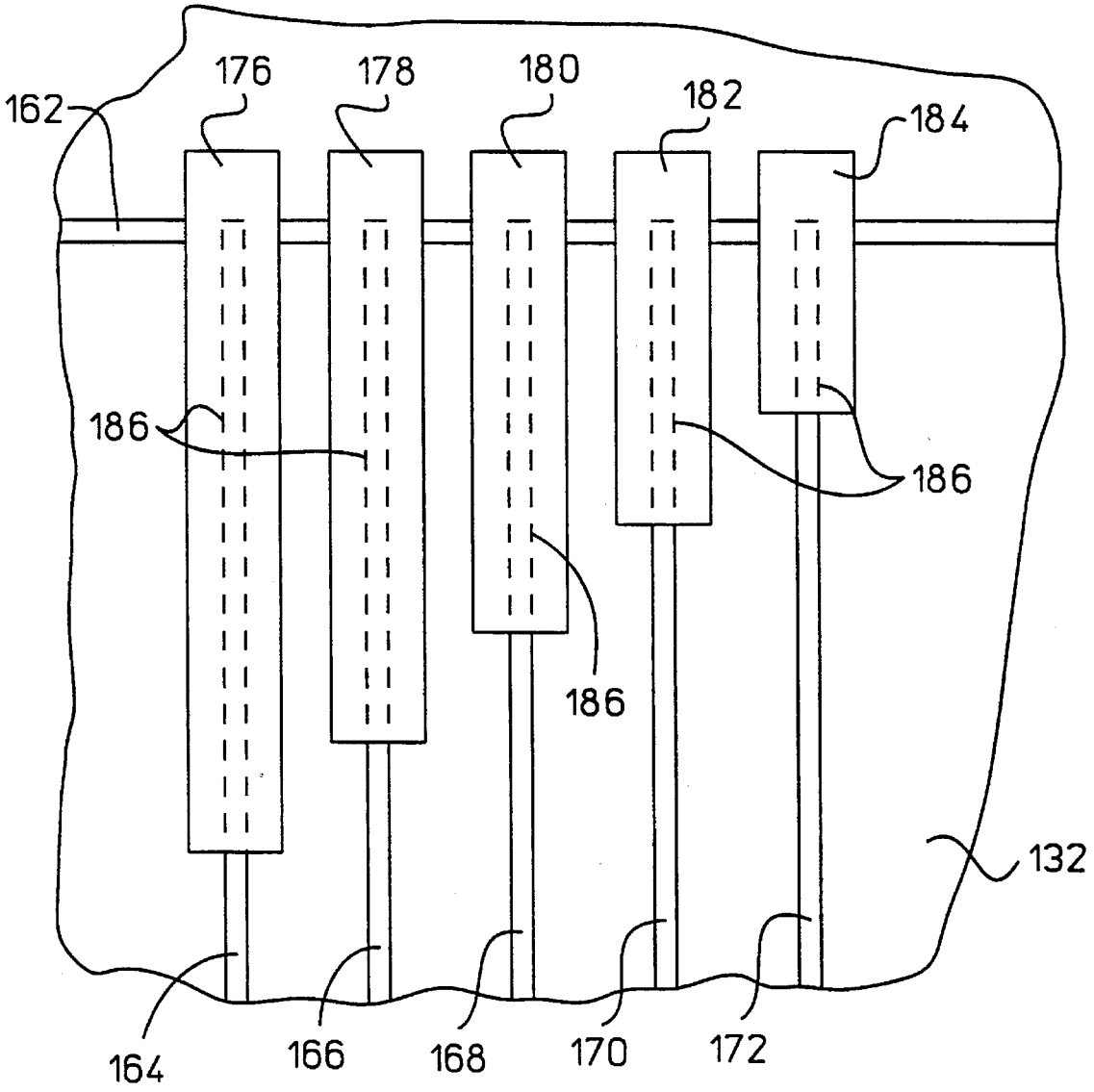
FIG. 7 is a top view of a 1×n switch adapted for use with attenuators.

FIG. 7 illustrates an embodiment of a 1×n switch. A single input line 162 and five output lines 164, 166, 168, 170 and 172 are shown on a signal substrate 174. Five thermally actuated members 176, 178, 180, 182 and 184 are suspended over the signal substrate by opposed legs, not shown, having a bi-material construction. On the lowermost surface of each thermally actuated member is a signal trace 186 that connects the input line 162 to an associated output line when the thermally actuated member is in a lowered position. An advantage of the structure of FIG. 7 is that the input line can be selectively connected to any one of five attenuators by individual actuation of the members 176–184.

We claim:

1. A signal switch comprising:

a first substrate having a first signal line extending along a surface of said first substrate; and an actuator supported for reciprocating movement in a direction generally perpendicular to said surface, said actuator having a first position and a second position, said actuator being operatively associated with a conductive member aligned to electrically connect to said first signal line when said actuator is in said first position, said conductive member being electrically isolated from said first signal line when said actuator is in said second position, said actuator having first and second layers having different coefficients of thermal expansion, said first and second layers being arranged to induce displacement of said actuator in response to introduction of thermal energy into said first and second layers.

2. The switch of claim 1 wherein said actuator is a second substrate connected in parallel relationship to said first substrate.

3. The switch of claim 1 further comprising an interposer substrate positioned between said first substrate and said actuator, said conductive member being formed on said interposer substrate, said interposer substrate being flexible in response to said displacement of said actuator.

4. The switch of claim 3 wherein said conductive member on said interposer substrate is supported in a manner to cause rotation of said conductive member when said actuator is moved between said first and second positions.

5. The switch of claim 3 wherein said interposer substrate includes a boss, said conductive member positioned on said boss in alignment with said first signal line of said first substrate.

6. The switch of claim 5 wherein said actuator includes a plurality of deformable legs aligned to displace said boss of said interposer substrate with movement of said actuator from said second position to said first position.

7. The switch of claim 1 wherein said actuator includes a plurality of deformable legs supporting a central region, said conductive member being aligned with said central region.

8. The switch of claim 1 wherein said first layer is silicon and said second layer is a conductive layer patterned to form an electrical pathway, including an input and an output.

9. The switch of claim 1 wherein said first substrate includes a second signal line spaced apart from said first signal line on said surface, said second signal line disposed to contact said conductive member when said actuator is in said first position, said conductive member thereby providing a signal path between said first and second signal lines.

10. The switch of claim 1 wherein said actuator is connected to an actuator substrate having a plurality of actuators supported for reciprocating movement, each actuator being operatively associated with a different conductive member.

11. A microminiature switch comprising:

a lower substrate having first and second signal lines on an upper surface;

an upper substrate positioned generally parallel to said upper surface, said upper substrate having a movable region having a raised and a lowered position and having a third signal line aligned to electrically connect said first and second signal lines when said movable region is in said lowered position; and an actuator substrate having a plurality of deformable legs having first and second layers, said first and second layers having substantially different coefficients of thermal expansion, said actuator substrate having at least one heater to selectively generate heat for deforming said legs as an effect of said difference in coefficients of thermal expansion, said actuator substrate being positioned atop said upper substrate such that deformation of said legs displaces said movable region of said upper substrate.

12. The switch of claim 11 wherein said actuator substrate is a silicon substrate and wherein said first and second layers of said legs are said silicon substrate and a metallic layer, respectively.

13. The switch of claim 11 wherein said upper substrate has a plurality of movable contact regions supported by legs for vertical movement, said actuator substrate having a corresponding plurality of arrangements of said legs in operative association with said movable contact regions.

14. The switch of claim 11 wherein said movable region is suspended in said raised position in the absence of said legs being heated to elevated temperatures.

15. The switch of claim 11 wherein said movable region is in said lowered position in the absence of said legs being heated to elevated temperatures.

16. The switch of claim 11 wherein said first and second layers of said deformable legs of said actuator substrate are silicon and nickel layers and wherein said upper substrate is a flexible polyimide substrate.

17. A microminiature switch comprising:

a first semiconductor substrate;

electrically conductive first and second traces on said first semiconductor substrate;

a second substrate patterned to form a suspended region having a conductive member, said second substrate connected to said first semiconductor substrate to align said conductive member to contact each of said first and second traces; and a bi-metallic structure on a side of said suspended region opposite to said conductive member, wherein conduction of thermal energy through said bi-metallic structure generates a thermal expansion differential sufficient to displace said conductive member relative to said first and second traces.

18. The switch of claim 17 wherein said second semiconductor substrate has a stationary region and has legs connecting said stationary region to said suspended region, said stationary region and said suspended region being portions of a unitary member.

19. The switch of claim 17 wherein said bi-metallic structure is a third substrate, said third substrate being a silicon substrate having a metallic layer.

20. The switch of claim 17 wherein said second substrate includes a plurality of suspended regions, each having a plurality of legs.

* * * * *